US010315228B2

(12) United States Patent
Pellegrin et al.

(10) Patent No.: US 10,315,228 B2
(45) Date of Patent: Jun. 11, 2019

(54) POSTAL SORTING EQUIPMENT WITH A TRAY INTERCHANGER FOR SLANTING L-SHAPED SHUTTLE TRAYS

(71) Applicant: Solystic, Bagneux (FR)

(72) Inventors: Laurent Pellegrin, Livron (FR); Olivier De Sousa, Montmeyran (FR); Jèrèmy Duboscq, Bourg les Valence (FR)

(73) Assignee: SOLYSTIC, Bagneaux (FR)

( * ) Notice: Subject to any disclaimer, the term of this patent is extended or adjusted under 35 U.S.C. 154(b) by 0 days.

(21) Appl. No.: 15/502,155

(22) PCT Filed: Nov. 7, 2016

(86) PCT No.: PCT/FR2016/052875

§ 371 (c)(1),
(2) Date: Feb. 6, 2017

(87) PCT Pub. No.: WO2017/109303

PCT Pub. Date: Jun. 29, 2017

(65) Prior Publication Data

US 2018/0297083 A1 Oct. 18, 2018

(30) Foreign Application Priority Data

Dec. 24, 2015 (FR) ..... 15 63311

(51) Int. Cl.
*B07C 3/00* (2006.01)
*B07C 3/08* (2006.01)

(52) U.S. Cl.
CPC ..... *B07C 3/008* (2013.01); *B07C 3/08* (2013.01)

(58) Field of Classification Search
CPC ..... B07C 3/08; B07C 3/008
(Continued)

(56) References Cited

U.S. PATENT DOCUMENTS 3,554,357 A * 1/1971 Molins ..... A24C 5/352 104/89
6,238,164 B1 * 5/2001 Isaacs ..... B07C 3/008 414/405
2017/0173639 A1 * 6/2017 Hanson ..... B07C 5/3412

FOREIGN PATENT DOCUMENTS

FR 3010920 A1 3/2015
WO 9920530 A1 4/1999
WO 2009071789 A1 6/2009

OTHER PUBLICATIONS

French Search Report dated Aug. 17, 2016 for Application No. 1563311.

* cited by examiner

*Primary Examiner* — Terrell H Matthews
(74) *Attorney, Agent, or Firm* — Patterson + Sheridan, LLP

(57) ABSTRACT

Postal sorting equipment for sorting flat mailpieces comprises a postal sorting machine, a storage-tray conveyor for conveying open-topped storage trays that are filled with mailpieces stacked flat, a shuttle-tray conveyor for conveying open-fronted shuttle trays that are substantially L-shaped, and in which the mailpieces are placed on-edge in stacks, and a tray interchanger that is suitable for automatically transferring the mailpieces stored flat in an open-topped storage tray to an open-fronted shuttle tray, the transfer being achieved by turning the storage tray over relative to the shuttle tray, which is held on a slant relative to the horizontal and vertical directions in order to obtain jogging by gravity of the transferred stack of mailpieces against the far inside surface of said shuttle tray.

5 Claims, 5 Drawing Sheets

(58) Field of Classification Search
USPC ..... 209/539, 540, 541
See application file for complete search history.

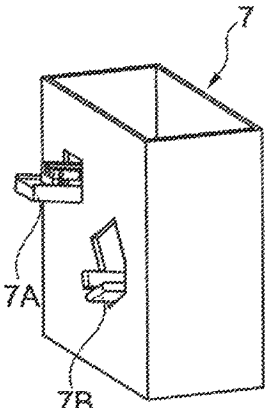
Fig. 5A
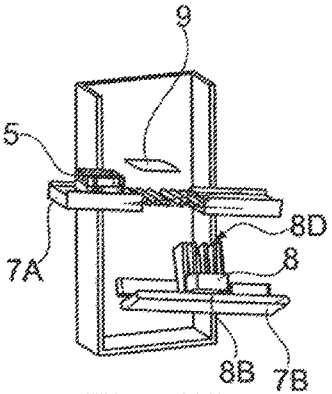
Fig. 5B
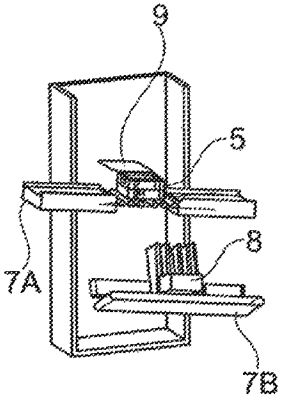
Fig. 5C
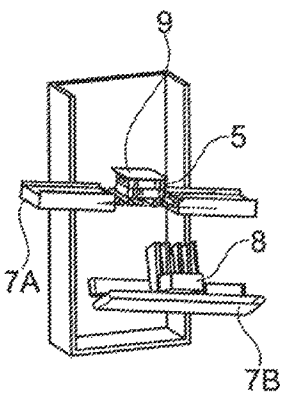
Fig. 5D
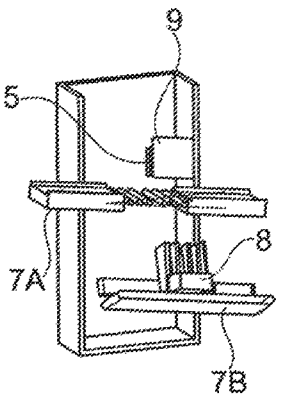
Fig. 5E
Fig. 5F
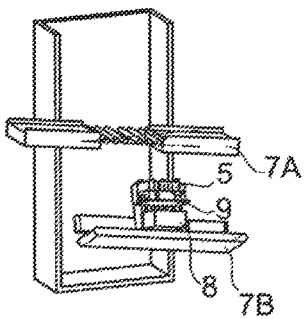
Fig. 5G
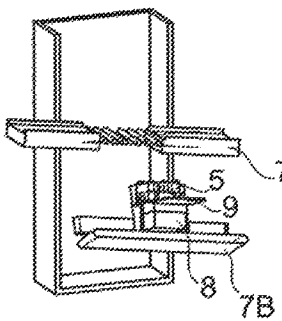
Fig. 5H
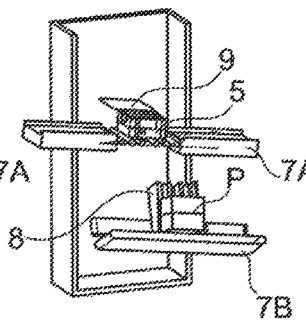
Fig. 5I
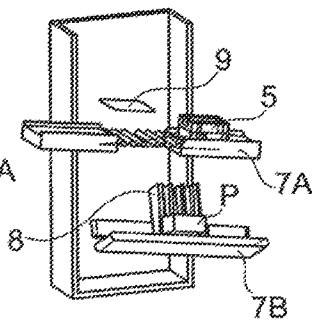
Fig. 5J

POSTAL SORTING EQUIPMENT WITH A TRAY INTERCHANGER FOR SLANTING L-SHAPED SHUTTLE TRAYS

TECHNICAL FIELD

The present invention relates to postal sorting equipment for sorting flat mailpieces, which equipment comprises a postal sorting machine having a feed inlet in which the mailpieces are placed on-edge in stacks, and a sorting conveyor in which the mailpieces are moved on-edge in series towards sorting outlets.

Such equipment is already known from patents FR 3 010 920, WO 2009/071789, and WO 99/20530.

In such known equipment, storage trays are used for recycling the mailpieces to the inlet of the machine. Such storage trays are conventional rectangular trays that are open-topped, which requires them to be emptied manually into the feed inlet of the machine.

In practice, the mailpieces are stored flat in stacks against the far inside surfaces of the storage trays. Each tray is turned over manually onto a motor-driven belt that feeds the unstacker of the machine. In order to retain the mailpieces on-edge in stacks on that motor-driven belt, the machine operative uses two retaining paddles mounted on arms that are mounted to slide along the magazine.

An object of the invention is to reduce the amount of handling by the machine operative in such equipment, and also to increase the rates at which the storage trays are emptied, and thus to increase the throughput rate of the sorting machine.

To this end, the invention provides postal sorting equipment for sorting flat mailpieces, which equipment comprises a postal sorting machine having a feed inlet in which the mailpieces are placed on-edge in stacks, and a sorting conveyor in which the mailpieces are moved on-edge in series towards sorting outlets, said postal sorting equipment being characterized in that it further comprises:

a storage-tray conveyor for automatically conveying open-topped storage trays that are filled with mailpieces stacked flat;

a shuttle-tray conveyor for conveying open-fronted shuttle trays that are substantially L-shaped, and in which the mailpieces are placed on-edge in stacks; and a tray interchanger through which the storage-tray conveyor and the shuttle-tray conveyor pass and that is suitable for automatically transferring the mailpieces stored flat in an open-topped storage tray to an open-fronted shuttle tray;

and in that said shuttle-tray conveyor is connected between the interchanger and the feed inlet of the sorting machine, in that, in the interchanger, the shuttle tray to be loaded is placed under the storage tray to be unloaded, and the transfer is achieved by turning the storage tray over relative to the shuttle tray, and in that said interchanger is arranged to cause the shuttle tray being transferred to be held on a slant relative to the horizontal and vertical directions in order to obtain jogging by gravity of the transferred stack of mailpieces against the far inside surface of said shuttle tray.

The sorting equipment of the invention may have the following features:

the feed inlet may comprise an unstacker with a fork-shaped magazine with tines, each of which is constituted by a motor-driven belt, the shuttle tray and the fork-shaped magazine being designed so that, by advancing towards the unstacker, the shuttle tray is engaged by the motor-driven belts of the magazine of the unstacker that come to be inserted under the stack of mailpieces disposed on-edge in said shuttle tray;

and said magazine of the unstacker may have a conveyor section that is mounted to move in elevation under the tines of the magazine, the shuttle tray resting on said conveyor section when it is engaged by the tines;

each L-shaped shuttle tray has a base, sloping ribs above the base that define the bottom of the tray, and a back wall formed by comb teeth in continuity with the sloping ribs;

the interchanger may include a mechanism for closing and opening the storage tray by means of a slidably mounted plate; and the shuttle tray preferably has a mailpiece storage capacity greater than, e.g. three times greater than, the storage capacity of a storage tray, and the tray interchanger is then arranged to transfer the contents of a plurality of storage trays to the same shuttle tray.

BRIEF DESCRIPTION OF THE DRAWINGS

The invention is described below in more detail and is illustrated by the drawings, in which:

FIGS. 5A to 5J show how mailpieces are transferred from a storage tray to a shuttle tray of the invention;

DESCRIPTION OF EMBODIMENTS

Figure 1:
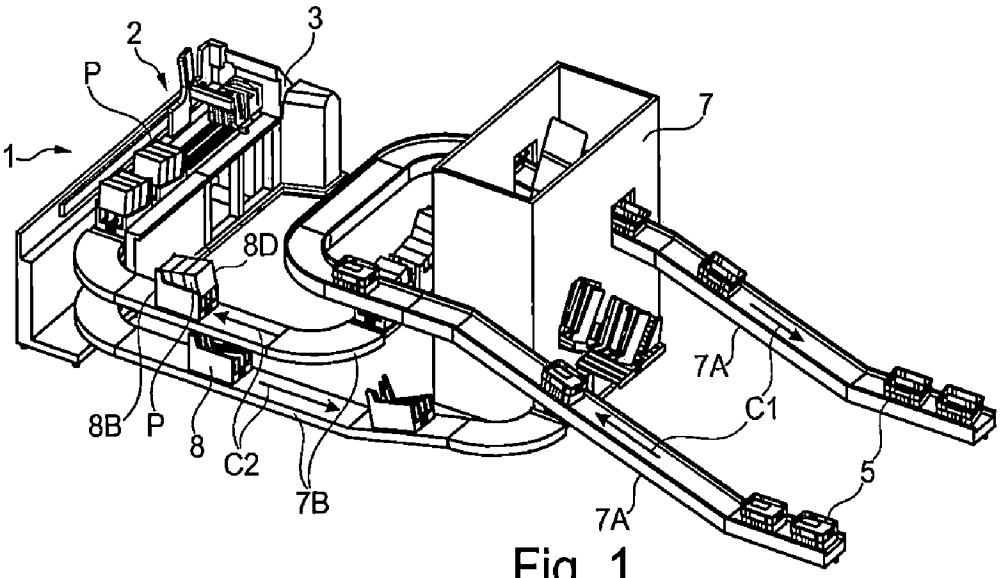
FIG. 1 is a diagrammatic perspective view of postal sorting equipment of the invention.
Figure 2:
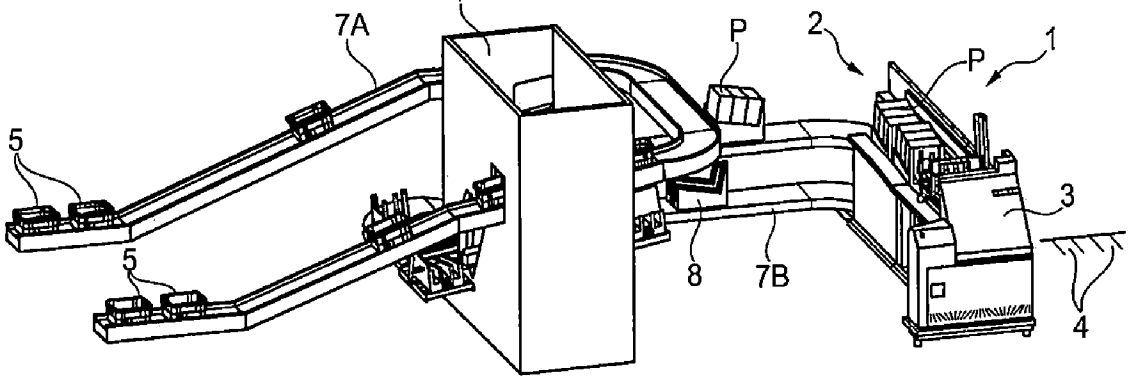
FIG. 2 is another perspective view of the postal sorting equipment shown in FIG. 1.

In FIGS. 1 and 2 of the drawings, postal sorting equipment of the invention is shown in fragmentary perspective.

This equipment comprises a postal sorting machine 1 having a feed inlet 2 (magazine of the unstacker) in which mailpieces P, and more particularly large-format flat mailpieces, are placed on-edge in stacks.

In conventional manner, the sorting machine 1 further comprises a sorting conveyor 3, e.g. a sorting conveyor having nipping belts, and in which the mailpieces P are moved on-edge in series towards sorting outlets 4 where they can be stored flat in stacks in open-topped storage trays 5.

In this example, it is considered that the storage trays 5 shown in the figures are placed in the sorting outlets, but the invention may extend to equipment in which the contents of the sorting outlets are transferred manually to storage trays 5 as shown in the figures.

In FIGS. 1 and 2, the sorting conveyor 3 is shown merely in very fragmentary manner, but naturally it may have a very large number of sorting outlets 4.

FIGS. 1 and 2 show a tray interchanger 7 through which a storage-tray conveyor 7A for conveying storage trays 5 and a shuttle-tray conveyor 7B for conveying shuttle trays 8 pass.

Figure 3:
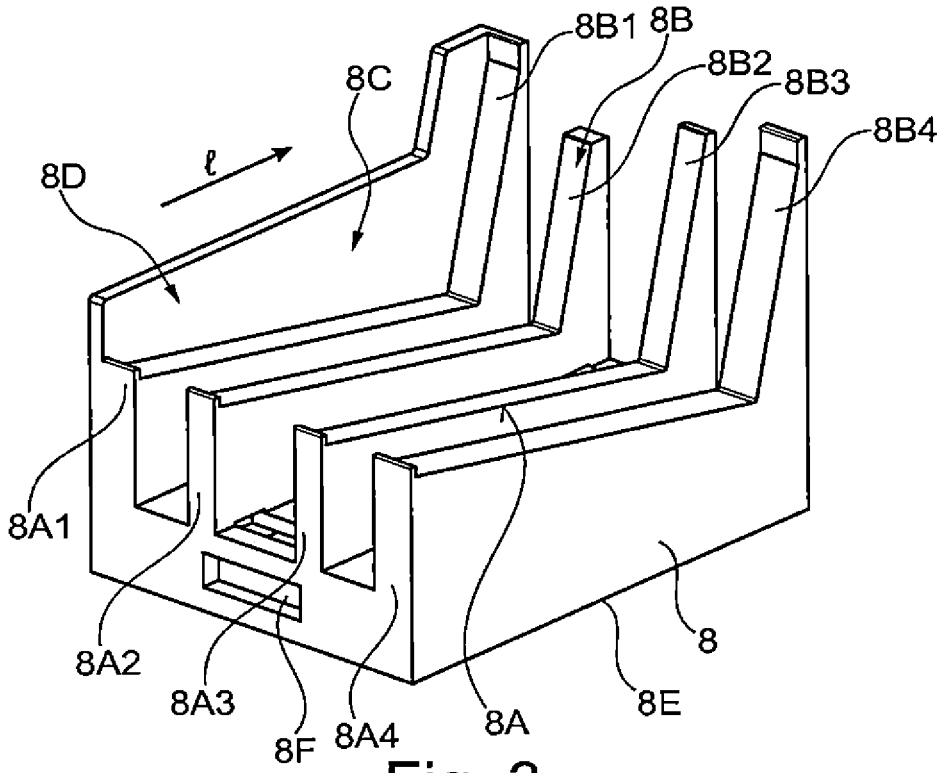
FIG. 3 is a diagrammatic perspective view of a shuttle tray of the invention.
Figure 4:
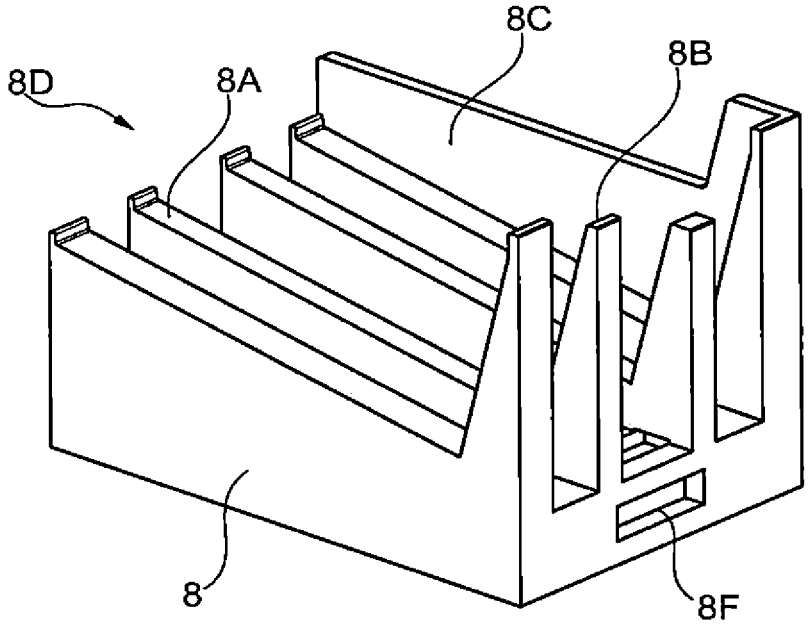
FIG. 4 is another perspective view of the shuttle tray shown in FIG. 3.

FIGS. 3 and 4 are perspective views of a shuttle tray 8. The shuttle tray is substantially L-shaped for storing mailpieces P on-edge.

The shuttle tray 8 has a sloping bottom 8A, a back wall 8B, a side wall 8C, and a front opening 8D.

In this example, the sloping bottom 8A is formed by four parallel ribs 8A1, 8A2, 8A3, 8A4 that extend in the longitudinal direction l of the tray 8 in such a manner as to be slanting relative to the plane base 8E of the tray.

As can be seen in FIGS. 3 and 4, the base 8E has a certain constant thickness going from the front to the back of the tray in the longitudinal direction k, thereby making it possible to provide the tray with two handling handles 8F respectively at the front and at the back of the tray in the thickness of the base.

As can be seen in FIGS. 3 and 4, the top surface of the base is parallel to the bottom surface of the base, the top surface extending between the ribs 8A1 and 8A2, the ribs 8A2 and 8A3, and the ribs 8A3 and 8A4.

The handles 8F also open out into the top surface of the base 8E between the ribs 8A2 and 8A3.

The ribs 8A1 to 8A4 have a profile that slopes downwards (by about 15°) relative to the top surface of the base 8E going from the opening 8D (at the front) towards the back wall 8B of the shuttle tray, i.e. the sloping bottom 8A of the tray that is constituted by the tops of the slanting ribs 8A1 to 8A4 is situated above the top surface of the base 8E and leaves a space into which a fork can be inserted as explained below.

The back wall 8B of the shuttle tray 8 is in the form of comb teeth and comprises teeth 8B1 to 8B4 that are in continuity with the ribs 8A1 to 8A4 and each of which has a face that faces towards the inside of the tray and that slants (at an inclination of about 15°) relative to the base of the tray, and a face that faces towards the outside of the tray and that is perpendicular to the base of the tray.

In this example, the side wall 8C connects the rib 8A1 to the tooth 8B1 so as to close the L-shape by interconnecting its two ends.

At the front of the shuttle tray, the end of each of the ribs 8A1 to 8A4 forms a sort of rim that projects a little towards the top of the shuttle tray.

In addition, the inside surface of the back wall 8B at the free ends of the teeth 8B1 to 8B4 forms a sort of rim that projects towards the top of the tray perpendicularly to the top surface of the base 8E.

As shown in FIGS. 1 and 2, the conveyor 7A is designed to transport storage trays 5 filled with mailpieces P that are stacked flat from a loading point (e.g. a sorting outlet of the sorting machine 1) to the interchanger 7, and to transport empty storage trays 5 from the interchanger to an empty-tray storage point. The direction of travel of the storage trays 5 in the conveyor 7A is indicated by arrows C1.

The conveyor 7B is connected to the feed inlet 2. It is adapted to bring empty shuttle trays 8 from the feed inlet 2 to the interchanger 7 and to transport the shuttle trays 8 filled with mailpieces on-edge in stacks from the interchanger 7 to the feed inlet 2. The direction of travel of the shuttle trays 8 in the conveyor 7B is indicated by arrows C2.

In the embodiment, the shuttle trays 8 have a storage capacity that is greater than the storage capacity of the storage trays 5. For example, it is possible to make provision for the shuttle trays to have a capacity that is triple the capacity of the storage trays 5.

Figure 6A:
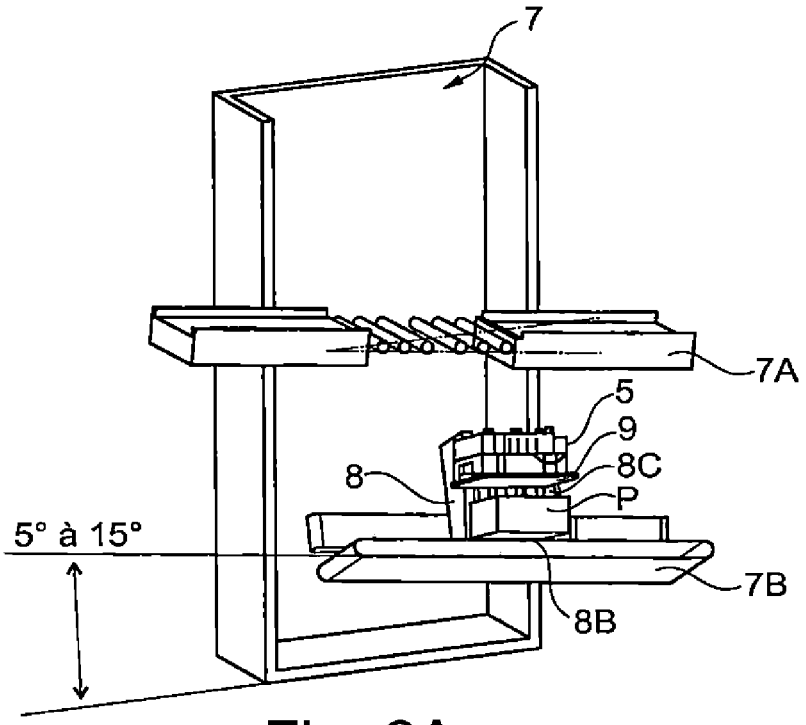
FIGS. 6A and 6B show the shuttle tray on a slant in the interchanger of the invention.
Figure 6B:
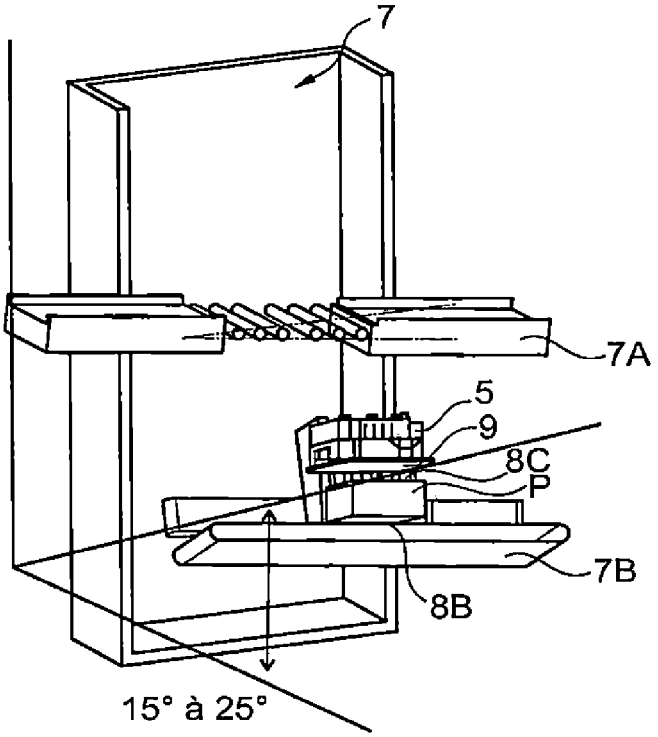

FIGS. 5A to 5J show the various manipulations of the storage tray 5 that are required for transferring its contents to a shuttle tray 8, in this example by turning the storage tray 5 over through about 180°-15° to 25° (angles shown in FIG. 6B).

At the beginning of the manipulation shown in FIGS. 5A to 5D, the storage tray has its opening facing upwards. A manipulator arm (not shown in the figures) comes to cover it with a plate 9.

From FIGS. 5E to 5G, the tray 5 that is situated above the L-shaped tray 8 is turned over. In FIG. 5H, the manipulator arm removes the plate (lid) 9, thereby causing the mailpieces P to fall against the far inside surface of the shuttle tray 8 while positioning themselves on-edge in a stack.

In FIGS. 5I to 5J, the manipulator arm puts the empty storage tray 5 back on the conveyor 7A so as to recycle the storage tray, e.g. to one of the sorting outlets of the sorting machine.

FIGS. 5A to 5J show the contents of a storage tray 5 being transferred to a shuttle tray 8 that is already loaded with mailpieces P. In the example shown, the shuttle tray 8 has a capacity that is triple the capacity of a storage tray 5 and can thus receive the contents of three storage trays 5 that are transported consecutively on the conveyor 7A.

In the tray interchanger 7, the shuttle tray 8 being transferred is preferably positioned to be slanting relative to the horizontal direction (e.g. at an angle in the range 15° to 25°) and relative to the vertical direction (e.g. at an angle in the range 5° to 15°) as shown in FIGS. 6A and 6B so as to generate an effect whereby the stack of articles on-edge P is jogged by gravity against the side wall 8C, with the beginning of the stack bearing against the back wall 8B.

Naturally, during the operation of transferring the mailpieces P to the shuttle tray 8, the conveyor 7B is at a standstill, as is the conveyor 7A.

As can be seen in FIG. 5B, in the transfer position, the shuttle tray 8 has its back wall 8B placed under the front opening 8D. When the shuttle tray 8 filled with mailpieces P exits from the interchanger 7, it is repositioned on the conveyor 7B in such a manner that its back wall 8B finds itself ahead of its front opening 8D.

FIGS. 7A to 7F show the various steps of loading the mailpieces P arriving in the shuttle trays 2 into the feed inlet 2 of the sorting machine.

As visible in the figures, the conveyor 7B is connected at the incoming end on the same horizontal plane as the motor-driven belt 2C of the unstacker of the feed inlet 2 but it is connected at the outgoing end below the horizontal plan of the magazine of the unstacker.

FIGS. 7A to 7F show the unstacking plate 10 of the unstacker of the sorting machine and also a stack-retaining paddle 11 that serves to cause the stack of mailpieces P to advance towards the unstacking plate.

The feed magazine 2A has a motor-driven floor constituted, in this example, by parallel motor-driven belts that are spaced apart by a distance that is sufficient to allow the ribs 8A1 to 8A4 and the teeth 8B1 to 8B4 of a shuttle tray 8 to pass through.

More particularly, the feed magazine 2A of the unstacker is fork-shaped with, in this example, three tines 2B, each of which is constituted by a motor-driven belt that extends horizontally towards the conveyor 7B. The bottom of the fork having the tines 2B of the magazine extends substantially to the unstacking plate 10.

The feed magazine 2A also has a conveyor section formed by a motor-driven conveyor belt 2C that is disposed below the motor-driven tines and that is mounted to move in vertical elevation, the space between the tines 2B and the conveyor belt corresponding to the thickness of the base 8E of a shuttle tray 8.

Figure 7A:
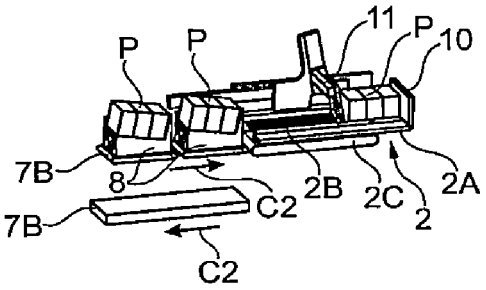
FIGS. 7A to 7F show how the mailpieces are loaded into the feed inlet with the shuttle trays being recycled.
Figure 7D:
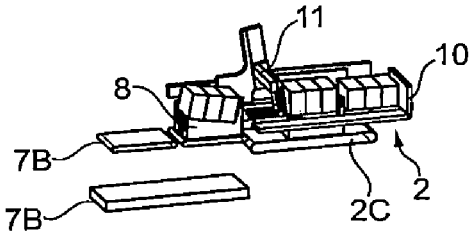
Figure 7B:
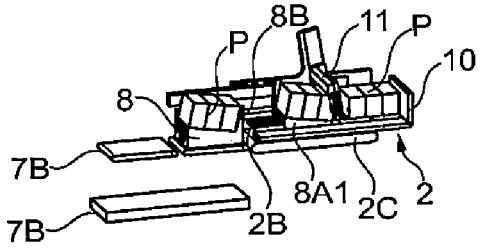

By advancing towards the unstacking plate 10 of the unstacker, the shuttle tray 8 filled with mailpieces P on-edge is engaged by the tines 2B of the magazine of the unstacker that come to be inserted under the stack of mailpieces between the ribs 8A1 to 8A4, while the base 8E of the shuttle tray comes to rest on the motor-driven belt 2C. In this way, the shuttle tray 8 is moved against the unstacking plate 10 or against the back of a stack of mailpieces already present in the feed magazine as shown in FIGS. 7A to 7C.

As can be understood from FIGS. 7A to 7F, the retaining paddle 11 is placed initially behind the stack of mailpieces P already inserted in front of the unstacking plate 10.

The shuttle tray 8 reaches the back of this stack of mailpieces with its back wall 8B to the fore.

As soon as the shuttle tray 8 is in abutment against the back face of the retaining paddle, the machine operative manipulates the retaining paddle and places it behind (facing the front opening of the shuttle tray) the retaining tray in the direction of advance in which the stack advances in front of the unstacking plate.

Then the machine operative causes the motor-driven belt 2C to descend, e.g. by pushing a control button (not shown). In FIG. 7D, the motor-driven belt 2C is shown in an intermediate descent position. While the shuttle tray 8 is descending, the mailpieces P are retained on-edge by the tines 2B of the magazine.

Figure 7E:
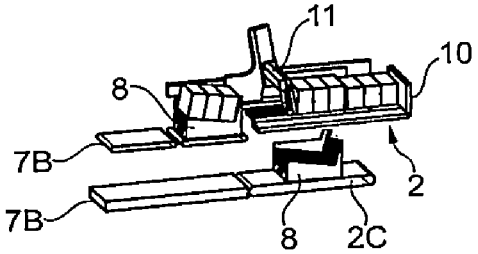
Figure 7C:
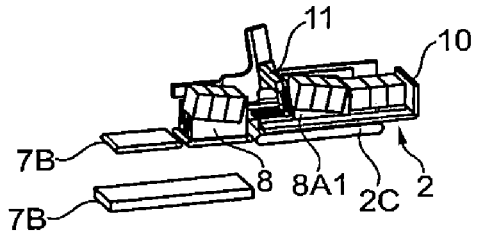

In FIG. 7E, the motor-driven belt 2C is now in the same horizontal plane as the conveyor 7B and the empty shuttle tray 8 can be moved on the conveyor 7B so as to be brought back towards the interchanger 7. In the example shown, the conveyor 7B arrives at and departs from the interchanger 7 on two levels that are offset vertically.

Figure 7F:
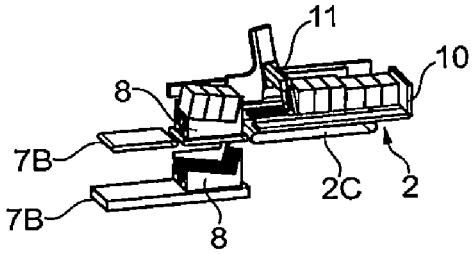

In FIG. 7F, the empty shuttle tray 8 has left the motor-driven belt 2C that can then go back up automatically and empty so as to receive another shuttle tray 8 filled with mailpieces.

The arrangement of the sorting equipment of the invention with the shuttle trays requires only a single retaining paddle 11, thereby simplifying the manipulations for the machine operative.

In addition, the shuttle tray preferably has a mailpiece storage capacity that is greater than, e.g. 3 times greater than, the storage capacity of a storage tray, and the tray interchanger is then arranged to transfer the contents of a plurality of storage trays to the same shuttle tray, thereby making it possible to obtain a higher throughput rate of about 2000 mailpieces per hour.

The invention claimed is:

1. Postal sorting equipment for sorting flat mailpieces, which equipment comprises a postal sorting machine having a feed inlet in which the mailpieces are placed on-edge in stacks, and a sorting conveyor in which the mailpieces are moved on-edge in series towards sorting outlets; said postal sorting equipment being characterized in that it further comprises:

a storage-tray conveyor for automatically conveying open-topped storage trays that are filled with mailpieces stacked flat;

a shuttle-tray conveyor for conveying open-fronted shuttle trays that are substantially L-shaped, and in which the mailpieces are placed on-edge in stacks; and a tray interchanger through which the storage-tray conveyor and the shuttle-tray conveyor pass and that is suitable for automatically transferring the mailpieces stored flat in an open-topped storage tray to an open-fronted shuttle tray; and in that said shuttle-tray conveyor is connected between the interchanger and the feed inlet of the sorting machine, in that, in the interchanger, the shuttle tray to be loaded is placed under the storage tray to be unloaded, and the transfer is achieved by turning the storage tray over relative to the shuttle tray, and in that said interchanger is arranged to cause the shuttle tray being transferred to be held on a slant relative to the horizontal and vertical directions in order to obtain jogging by gravity of the transferred stack of mailpieces against the far inside surface of said shuttle tray.

2. Sorting equipment according to claim 1, characterized in that the feed inlet comprises an unstacker with a fork-shaped magazine with tines, each of which is constituted by a motor-driven belt, the shuttle tray and the fork-shaped magazine being designed so that, by advancing towards the unstacker, the shuttle tray is engaged by the motor-driven belts of the magazine of the unstacker that come to be inserted under the stack of mailpieces disposed on-edge in said shuttle tray; and in that said magazine of the unstacker has a conveyor section that is mounted to move in elevation under the tines of the magazine, the shuttle tray resting on said conveyor section when it is engaged by the tines.

3. Equipment according to claim 1, characterized in that each L-shaped shuttle tray has a base, sloping ribs above the base that define the bottom of the tray, and a back wall formed by comb teeth in continuity with the sloping ribs.

4. Equipment according to claim 3, characterized in that the interchanger includes a mechanism for closing and opening the storage tray by means of a slidably mounted plate.

5. Equipment according to claim 1, characterized in that the shuttle tray has a mailpiece storage capacity greater than the storage capacity of a storage tray, and in that the tray interchanger is arranged to transfer the contents of a plurality of storage trays to the same shuttle tray.

* * * * *